United States Patent [19]

Dolata et al.

[11] Patent Number: 4,459,890

[45] Date of Patent: Jul. 17, 1984

[54] SAW CHAIN FOR POWER SAW

[75] Inventors: Hans Dolata, Waiblingen; Werner Meyle, Murr; Adam Kelbert, Waiblingen; Karl Nitschmann, Schorndorf, all of Fed. Rep. of Germany

[73] Assignee: Andreas Stihl, Waiblingen, Fed. Rep. of Germany

[21] Appl. No.: 439,528

[22] Filed: Nov. 4, 1982

Related U.S. Application Data

[63] Continuation of Ser. No. 193,895, Oct. 6, 1980, abandoned.

[30] Foreign Application Priority Data

Jan. 22, 1980 [DE] Fed. Rep. of Germany ..... 3002115

[51] Int. Cl.[3] ..... B27B 33/14

[52] U.S. Cl. ..... 83/834; 83/830

[58] Field of Search ..... 83/834, 833, 830; 30/383

[56] References Cited

U.S. PATENT DOCUMENTS

| | | | |
|---|---|---|---|
| 3,329,183 | 7/1967 | Robinson | 83/834 |
| 3,951,027 | 4/1976 | Arff | 83/834 |
| 4,133,239 | 1/1979 | Goldblatt | 83/834 |

*Primary Examiner*—Donald R. Schran

*Attorney, Agent, or Firm*—Walter Ottesen

[57] ABSTRACT

A saw chain, for power saws, having cutting links alternately on the right-hand and left-hand sides, central driving links, and lateral connecting links. The individual links are pivotally interconnected by means of pins. At least some driving links are provided with a safety projection, which extends in the opposite direction to the direction of rotation. The outer edge of the safety projection is radially farther than the outer edges of the connecting links of the following driving link. As the chain rotates around the free end of the guide rail, in the direction of travel, the rearmost section of the outer edge of the safety projection describes a trajectory which is greater by predetermined amount than the trajectory described by the tip of the cutting tooth.

14 Claims, 4 Drawing Figures

SAW CHAIN FOR POWER SAW

This is a continuation of application Ser. No. 193,895, filed Oct. 6, 1980, now abandoned.

FIELD OF THE INVENTION

The invention relates to a saw chain, for power chain saws, having cutting links alternately on the right-hand and left-hand sides, central driving links, and lateral connecting links. The individual links are pivotally interconnected by means of pins. At least some driving links are provided with a safety projection, which extends in the opposite direction to the direction of rotation. The outer edge of the safety projection is radially farther than the outer edges of the connecting links of the following driving link.

BACKGROUND OF THE INVENTION

In saw chains of this type (U.S. Pat. No. 3,329,183 Robinson issued July 4, 1967 and German Offenlegungsschrift No. 1 503 987), it is known for the chain to be guided during operation in the guide groove of a guide rail, and to travel in a relatively small curve around the free outer end of the guide rail. In so-called plunge-cutting operations, in which the free end of the guide rail with the rotating chain strand plunges into the wood to be cut, despite the depth limiters provided thereon, the cutting teeth may engage too deeply in the wood. This may lead to an undesirable kick-back of the chain saw, i.e. to a sudden movement of the saw in the direction of the operator.

In known saw chains, in order to prevent a kick-back of this type, which is dangerous for the operator, the driving links have already been provided with safety projections. These safety projections extend from the cutting edge of a leading cutting link in the direction of the depth limiter of the subsequent cutting link. Their outer edges are provided at least partly above, or radially farther, than the outer edge of the connecting link of the subsequent driving link.

In the known construction, the safety projection of the driving link is constructed in the manner of a horn. In this case, the outer edge of the safety projection which points in the direction of the bottom of the groove of the kerf, is curved in a convex manner. As a result of this, the highest point of the curve lies approximately at the center of the horn-shaped projection. As the saw chain travels around the free end of the guide rail, the safety projection lifts clear of the guide rail. Because of this, the guide rail should be held at a sufficiently great distance from the actual cutting point in order to prevent the cutting teeth from engaging too deeply, in an undesirable manner, at the time of plunge-cutting operations. Therefore, the convex outer edge of the safety projection does not project beyond the height of the cutting tooth and, due to its outwardly curved shape, should ensure smooth travel of the chain in the saw kerf. It has been found that in saw chains of the aforementioned type, the kick-back effect cannot be prevented in a satisfactory manner.

SUMMARY OF THE INVENTION

It is therefore an object of the present invention to provide a saw chain which, with a low overall height and optimum cutting efficiency as a result of a controlled lever action, limits the cutting depth of the cutting links in plunge-cutting operations to a predetermined dimension, thereby excluding the kick-back effect.

The invention is characterized primarily in that, as the chain rotates around the free end of the guide rail, the rearmost section of the outer edge of the safety projection, as seen in the direction of travel, has a trajectory which is greater, by a predetermined amount, than the trajectory of the tip of the cutting tooth.

Thus, appropriately, the outer edge of the safety projection may extend at least approximately parallel to a line connecting the centers of the recesses which are located in the driving link and which receive the connecting pins or rivets.

Further details of the advantageous constructions of the present invention are described later in the specification.

As a result of the construction according to the invention, a predetermined force acts on the driving link which is provided with the safety projection, when the chain rotates around the free end of the guide rail, at an exactly predetermined point of the safety projection, namely on the rearmost section of the outer edge of the safety projection, as seen in the direction of travel. This force moves the safety projection downwards about the pivot point nearest thereto, thus lifting the leading part of the driving link, as well as the attached rear part of the cutting link with its cutting edge, clear of the guide rail. The rearmost part of the back of the tooth of the cutting link is pushed upwards towards the cutting radius as a result of the torques which occur. The cutting edge of the cutting tooth comes increasingly into engagement and the cutting tooth itself is raised slightly from the guide rail. The cutting force now acting at the cutting edge of the cutting tooth causes a further rotation of the cutting tooth in the opposite direction to the direction of rotation, until the cutting edge of the tooth engages fully, and the curved projecting rear of the depth limiter comes to bear fully in the bottom of the cut.

There is thus a predetermined lever action controlled by the rearmost section of the outer edge of the safety projection. This lever action, according to the momenta produced, brings the cutting tooth firstly into abutment in a positively controlled manner, and then continuously and increasingly into full cutting engagement. As a result of this positive control, the cutting teeth are first of all prevented from penetrating immediately in the wood, and a penetration cannot take place in an uncontrolled manner. Kick-backs can no longer occur, since, due to the positive control according to the invention, only a limited penetration of the cutting teeth is possible with an increasing advance.

Advantageously, the outer edge of the safety projection is rectilinear. Preferably it is constructed parallel to the line connecting the centers of the recesses in the driving link. In such a case, the end section of this safety projection is likewise constructed as a rectilinear section, in order to bear in the bottom of the groove at the time of plunge-cutting operations. This end section is rounded off with a small radius, for example of less than 1 mm, but preferably 0.25 to 0.5 mm.

BRIEF DESCRIPTION OF THE DRAWING

The invention will now be described with reference to the drawing wherein.

DESCRIPTION OF THE PREFERRED EMBODIMENTS OF THE INVENTION

Figure 1:
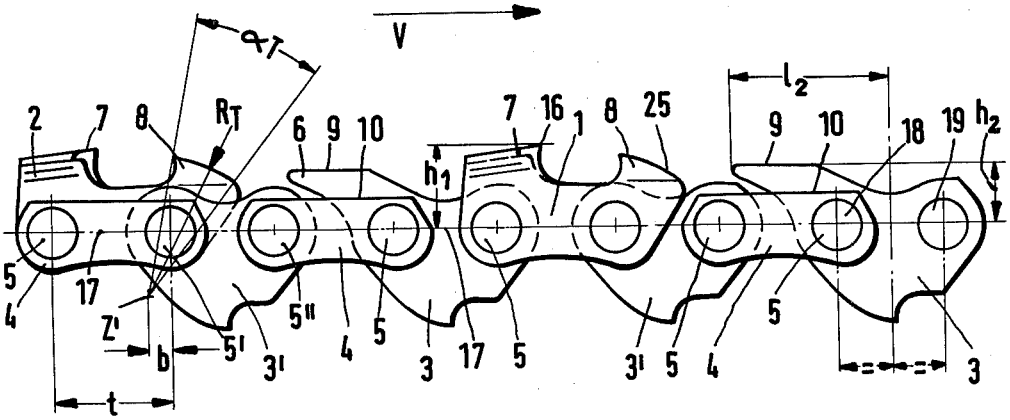
FIG. 1 is a portion of a chain constructed according to the invention in side view and in the elongated position, as when travelling over the straight part of a guide rail.

Referring now to the drawings in detail, the device shown therein comprises, as seen in the direction of travel V in FIG. 1, cutting links 1 on the right-hand side and cutting links 2 on the left-hand side in a manner known per se. These cutting links 1, 2 are provided, by way of example, with roof-shaped cutting edges 7. Parallel to the cutting links 1, 2 are lateral connecting links 4, between which central driving links 3 are located. The cutting link 2 on the left-hand side (illustrated on the left in FIG. 1) is connected to a lateral connecting link 4 on the right-hand side by the trailing pin or rivet 5. Seen in the direction of travel V, the central driving link 3′ is located between the links 2, 4 and is connected thereto by the leading pin or front link pin 5′. Driving link 3′ is located with its rear section approximately below the depth limiter 8, and is connected to the cutting link 2.

The front section of the driving link 3′ is connected to two lateral connecting links 4 by means of a link pin 5″. A driving link 3, constructed according to the invention, is received and held between connecting links 4 by means of a further link pin 5. This driving link 3 is provided with a safety projection 6, and its front section is pivotally connected by means of the link pin 5 to the right-hand cutting link 1, which is provided with the depth limiter 8 and is located in front of the left-hand cutting link 2 in the feed direction.

There then follows an arrangement of links in sequence having a normal driving link 3′ without safety projection, parallel lateral connecting links 4 on the right-hand side and left-hand side, with a driving link 3 located therebetween having safety projections 6 and constructed according to the invention. The latter form a saw chain which consists alternately of cutting links 1, 2 on the right-hand side and left-hand side, central driving links 3, 3′, and lateral connecting links 4, which are all pivotally interconnected by pins 5, 5′, and 5″.

In the embodiment, every other driving link 3 is provided with a safety projection 6. As shown clearly in FIG. 1, this safety projection 6 extends approximately from the right-hand side cutting edge 7 of the leading cutting link 1 in the direction of the depth limiter, gauge, member or means 8 of the following cutting link 2. The outer edge 9 of the safety projection 6 is located, at least partly, and in the embodiment completely, above the outer edges 10 of the two lateral connecting links 4 which are arranged parallel to each other.

A driving link 3 with safety projection 6 is located between the cutting link 1 on the right-hand side and the following cutting link 2 on the left-hand side as seen in the direction of travel V, and is connected, on one end, to the cutting link 1 on the right-hand side. On its opposite end the driving link 3 is connected to a pair of lateral connecting links 4, which are, in turn, connected to a driving link 3′, having no safety projection. The driving link 3′ is, in the pictured embodiment, pivotally connected to the cutting link 2 on the left-hand side, which follows it. Accordingly, the chain consists of a succession of the groups of chain links described.

In order to provide a predetermined, controlled lever action for the engagement of each cutting link, the safety projection 6 is constructed, according to the invention, so that during the rotation of the chain about the free end 12 of the guide rail 11 (see FIG. 2), the rearmost section 15 of the outer edge 9 of the safety projection 6, as the chain moves in the direction of travel V, describes a trajectory 13. This trajectory 13 is greater by a predetermined amount, namely the amount "s" marked in FIG. 2, than the trajectory 14 described by the tip 16 of a cutting tooth 1, 2 which precedes the safety projection 6.

Accordingly, in the illustrated embodiment, the driving link 3 having the safety projection 6 (see FIG. 4) is constructed so that the outer edge 9 of the safety projection 6 extends parallel to the line 17 connecting the centers of the recesses 18, 19, which serve to receive the connecting pins or rivets 5. The outer edge 9 may also have a different construction; for example, it may be concave or even slightly domed. However, in that case it is essential that only the rearmost section 15 of the outer edge 9 projects beyond the trajectory 14 described by the tip 16 of the cutting tooth 1, 2, during rotation of the chain over the free end of the guide rail.

One advantageous embodiment of the driving link 3 having a safety projection 6 is thus provided when, in the elongated position of the chain and during rotation about the free end 12 of the guide rail 11, no point of the outer edge 9 is higher than the rearmost section 15 of the outer edge 9 of the safety projection 6.

Figure 4:
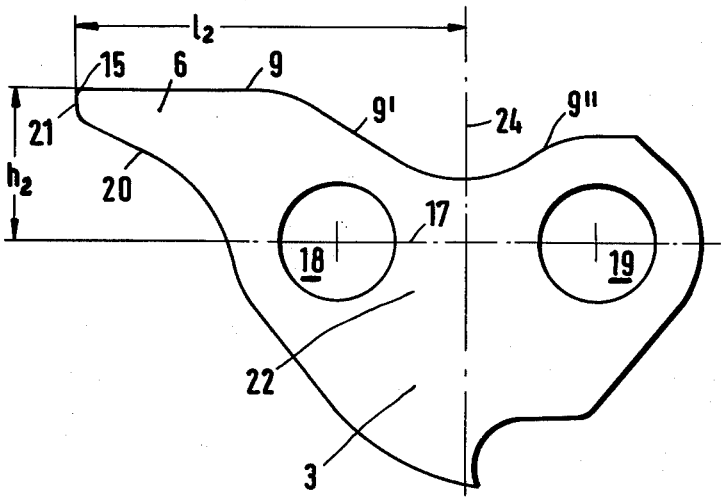
FIG. 4 shows a driving link of the chain illustrated in FIGS. 1 to 3 with the safety projection constructed according to the invention to an enlarged scale.

FIG. 4 shows an advantageous construction of the driving link 3 having a safety projection 6, in an enlarged illustration. In this embodiment, the end section 21 of the safety projection 6 is advantageously constructed as a straight section in order to bear in the bottom of the groove 23 during plunge-cutting operations, and is provided with a small radius, which is not greater than 1 mm, but is preferably 0.5 mm. In order to achieve adequate stability with a low weight of the driving link, the inner edge 20 of the end 21 of the safety projection 6 is guided in a concave curve towards the center 22 of the driving link 3.

For the same reason, plus a simultaneous saving on material and weight, the outer edge 9 of the safety projection 6 is guided so that it changes from the straight shape 9 into a curve 9′, which firstly extends in a concave manner towards the center 22 of the driving link 3. A convex portion of the curve 9″ adjoins this curve 9″ in the region above the leading recess 19, so that the recess 19 is, on more than a quarter of its front part, surrounded approximately in the form of a ring by the body of the driving link 3.

According to a further feature of the invention, the outer edge 9 of the safety projection 6 may have a cross section tapering outwards, for example, a cross section which narrows in an upwards direction in the shape of a wedge, pointed arch, semi-circular arch, or knife edge. Due to such a construction of the upper edge of the safety projection or safety and chain links in general, it is possible to achieve a reduction of the feed pressure at the time of cutting operations.

It has been found that in chains having a low overall height, the lifting action of the cutting link, according to the invention, occurs in an optimum manner if the difference between the diameter of the trajectory 13 described by the safety projection 6, and the diameter of the trajectory 14, described by the cutting link tips 16, is approximately 0.5 to 1.5 mm, preferably 1 mm.

Figure 2:
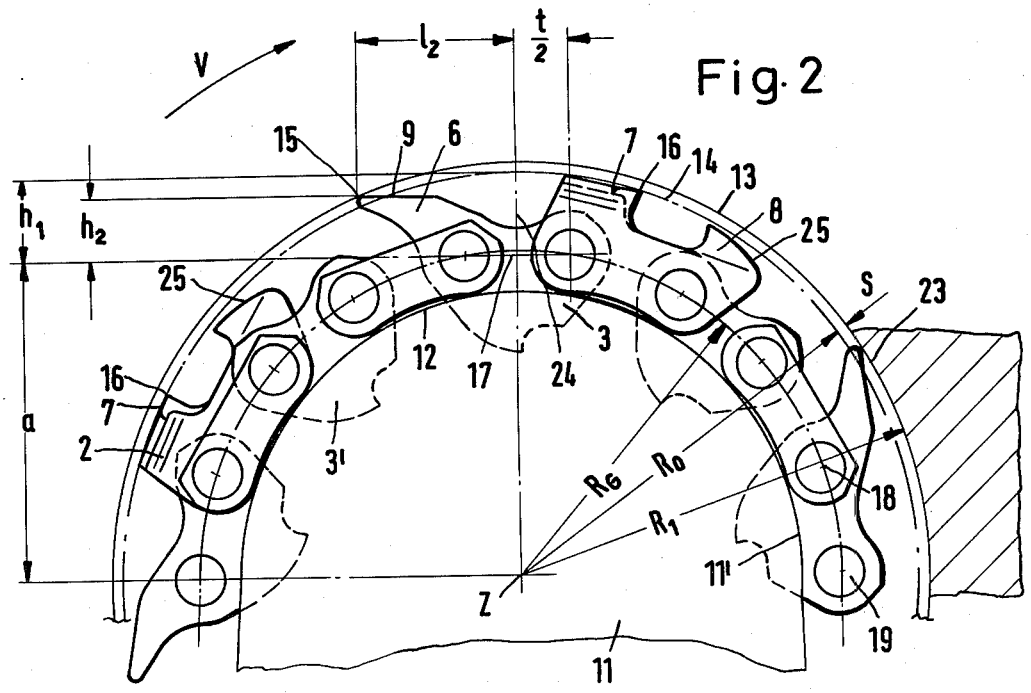
FIG. 2 shows the free end section of a guide rail with the position of the chain when travelling over the head of the guide rail.
Figure 3:
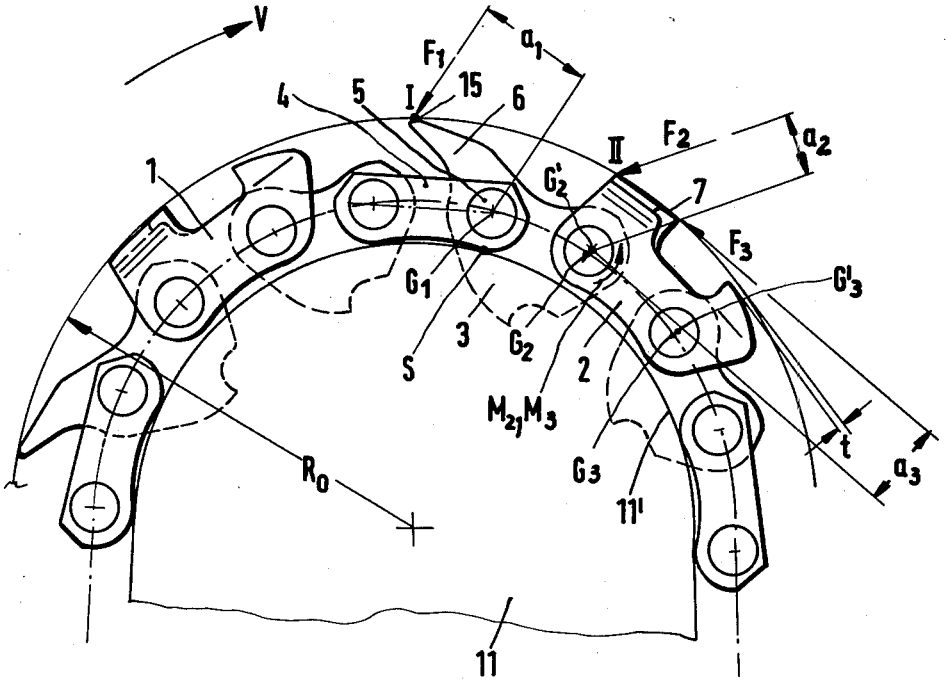
FIG. 3 shows the position of the individual chain links when travelling around the head of the guide rail and with respect to the cutting radius at an instant at the beginning of the cutting operation.

FIG. 2 shows that when the chain rotates around the free end 12 of the guide rail 11, the end section of the safety projection 6 projects by the differential amount "s" beyond the trajectory 14 described by the cutting tip 16 of the cutting teeth 1, 2. In the position illustrated in FIG. 2, the cutting teeth are not yet in engagement, since in this position the feed pressure is not yet effective. As soon as the feed pressure is initiated, the chain begins to cut. FIG. 3 shows the position of the individual chain links with respect to the guide rail 11 and to the cutting radius $R_o$ and, in particular, at the instant of the beginning of the cutting operation.

Thus, at the point I, at the time of starting up, the force $F_1$ acts on the end section 15 of the safety projection 6. Due to this, the driving link 3 rotates about the pivot point $G_1$ of the connecting pin 5. The pivot point $G_1$ is supported by way of the lateral connecting links 4 at the point S on the guide rail 11. At the same time, the pivot point $G_2$, namely the center point of the front connecting pin 5 which connects the driving link 3 with the rear end of the cutting link 2, in the direction of rotation V, travels in a positive manner from $G_2$ to $G_2'$.

Consequently, the cutting tooth 2 is raised from the rail 11 at the rear end and is pressed, with the back of the tooth at the point II, towards the cutting radius $R_o$. At this instant, the force $F_2$ acts at the point II and presses at the point II on the back of the tooth, so that a moment $M_2=F_2\times a_2$ acts about the center point of the pivot pin, i.e. about the point $G_2$. This moment $M_2$ now rotates the cutting tooth 2 about the point $G_2$ towards the left, in the opposite direction to the direction of travel V, until the cutting edge 7 of the cutting tooth 2 comes into engagement in the wood to be cut.

Thus, the pivot point $G_3$, i.e. the center point of the leading connecting pin of the cutting tooth 2, is raised slightly with the leading driving link and moves from the position $G_3$ into the position $G_3'$. In this case, the cutting tooth 2 is raised, as a whole, slightly away from the track 11' of the rail 11. Furthermore, the cutting force $F_3$ is produced, which with the lever arm $a_3$ causes the moment $M_3=F_3\times a_3$ about the point $G_2'$. This causes a further rotation of the cutting tooth 3 about the point $G_2'$ which continues until the cutting edge 7 of the cutting tooth 2 is fully in engagement and the parameter $t=0$.

As a whole, the construction, according to the invention, provides a positively controlled lever action. This lever action is initiated by the rearmost section 15 of the outer edge 9 of the safety projection 6, which projects beyond the trajectory 14 of the cutting links 1, 2, upon the rotation about the free end of the chain. It leads to a continuous, smooth, and gentle abutment firstly of the end point of the back of the tooth and secondly of the cutting edge 7 of the cutting tooth. In this case the cutting tooth itself is firmly raised slightly from the track 11' of the rail 11. As a result, after the cutting force $F_3$ comes into being and after a furter rotation of the cutting tooth 2, the cutting edge 7 of the tooth finally comes into full engagement.

Because of the construction of an embodiment according to the invention, the cutting teeth are prevented from penetrating the wood in an uncontrolled manner and thus from causing kick-back effects. This construction facilitates a limited, accurately controlled penetration of the cutting teeeth 1, 2 with increasing feed. Consequently, it has become possible to virtually eliminate the kick-back effect.

In the advantageous embodiment illustrated, the amount s amounts to approximately 1 mm. The height $h_2$ (see FIGS. 2, 3) should be kept as small as possible, in order not to restrict the chip space undesirably. An inadequate chip space impairs the degree of efficiency of the chain, therefore restricting the chip removal.

For the construction of an advantageous embodiment of the chain according to the invention, the following geometric conditions have proven particularly advantageous: the height $h_2$, which is measured between the rearmost section 15 of the outer edge 9 of the safety projection 6 and the line 17 connecting the centers of the recesses 18, 19 in the driving link 3, should be at the most three-quarters of the distance $h_1$, which is measured between the diameter of the trajectory 14 of the tips of the cutting links 1, 2 and this line 17. Furthermore, the length $l_2$, between the free end of the outer edge 9 of the safety projection 6 and the line 24 which is perpendicular to the center of the driving link 3, should be at least equal to twice the distance $h_1$.

The following relationships thus exist:

$$h_2 \leqq \tfrac{3}{4} h_1$$

$$l_2 \geqq 2 h_1$$

The length $l_2$ thus also follows the following geometric equation:

$$l_2 \geqq \sqrt{R_1^2 - (a + h_2)^2},$$

in which case $$a = \sqrt{R_G^2 - \left(\frac{t}{2}\right)^2}$$

For this purpose, $R_1$ is the radius of the trajectory 13 described by the safety projection 6, a is the radial extend between the center Z of the track 11' of the rail 11 and the line 17 connecting the centers of the link pins of the driving link 3, $R_G$ is the radius from the center Z to the middle of the link pin 5, and t is the pitch of the chain (see FIG. 2).

Furthermore, the following geometric equations are thus provided:

$$R_1 \geqq \sqrt{R_G^2 - \left(\frac{t}{2}\right)^2} + h_1 + 1$$

$$R_o = \sqrt{R_G^2 - \left(\frac{t}{2}\right)^2} + h_1$$

In addition, the shape of the depth limiter is essential for the cutting behavior in the case of plunge cutting and longitudinal cutting operations. Accordingly, the depth limiter is constructed with a curved shape, in which case the outer edge 25 of the depth limiter 8 has at least approximately a curve length of $\alpha_T$, which is approximately 22 degrees, and a radius which is adapted, at least approximately, to the cutting radius $R_o$.

In FIG. 1, the geometric features for the construction of the depth limiter are illustrated diagrammatically. Accordingly, an appropriate embodiment exists if the distance b, which is measured between the center of the link pin 5 on the depth limiter 8 and the center Z' of the radius $R_T$, corresponds to approximately one-fifth of the pitch of the chain. Additionally, as a result of this position of the center Z' of the radius $R_T$ of the upper edge 25 of the depth limiter 8, the radius $R_T$ itself should be approximately equal to or greater than two-fifths of the cutting radius.

Therefore, expressed geometrically, the following conditions exist for the position and size of the radius $R_T$ for the upper edge 25 of the depth limiter 8:

$$b \approx \frac{1}{5} \times t$$

$$R_T \gtrapprox \frac{2}{5} \times R_o$$

$$\alpha_T \approx 22°$$

This produces a depth limiter 8 having an upper edge 25 which is relatively long, as viewed in the direction of rotation, drops away slightly in the direction of rotation, and is slightly domed.

As a result of the combination of the safety projection 6 on the driving link 3, and the depth limiter 8, which is located relatively far from the upper end of each cutting tooth and comprises a relatively broad outer edge 25, optimum cutting results occur both in the case of cutting-off as well as in plunge cutting operations, while excluding the dangerous kick-back effects, especially at the time of plunge cutting operations. Due to the fact that only the end point of the safety projection 6 comes into abutment first of all and on its own, during the rotation about the free end of the guide rail, it is ensured that the effective lever length $L_2$ (see FIG. 2), which is necessary for the positive control of the cutting links, always remain constant and, therefore, the forces acting on the cutting teeth 1, 2 always keep the same value.

It is conceivable that the safety projection 6 also be located on a link other than the driving link 3 of the saw chain. Even in this case, the safety projection 6 would have a rear section 15 on its outer edge 9, which would correspond to the section 15 of the illustrated driving link 3. Also, this section 15, which could be located on any chain link, likewise has a trajectory which is greater by a predetermined amount s than the trajectory described by the tip of the cutting teeth 1, 2.

The section 15 of the outer edge of the safety projection, which forms the abutment in the bottom of the groove, can be constructed as a bearing face. The bearing face is located at right angles at the direction of travel, and seen in a vertical projection in the direction of the chain link, projects laterally beyond the chain link. The bearing face is accordingly larger than the material thickness of the chain link associated with the bearing face. This bearing face can be formed directly from the body of the chain link or a projection on the chain link, by bending-over, compression, or other methods of construction.

The chain, according to the invention, is particularly characterized by the fact that the parts of the chain links, which are located above the connecting pins 5, 5', 5'', etc., are, in an optimum manner, constructed to be low. Overall this produces a chain with an extremely low profile in comparison with known chain constructions.

The present invention is, of course, in no way restricted to the specific disclosure of the specification and drawings, but also encompasses any modifications within the scope of the appended claims.

What we claim is:

1. A saw chain for a power-driven chain saw useable in a plunge-cutting mode of operation and having a cutter bar defining a track for accommodating and guiding the saw chain as it moves along the cutter bar, the cutter bar having an outer end defining a predetermined curvature for the guide track, the saw chain comprising:

a plurality of cutting links, a plurality of connecting links, and a plurality of driving links, the links being pivotally interconnected by rivets or the like to define the saw chain, the cutting links including:

a plate-like body having a rearward wall defining a rearward opening for accommodating one of the rivets;

the rearward wall having an upwardly extending bent-over top portion defining the cutting tooth of the cutting link and a downwardly extending portion defining a rearward bottom edge of the cutting link, the cutting tooth being elongated and having a forward end defining the cutting edge thereof;

a forward wall having a downwardly extending portion defining a forward bottom edge of the cutting link;

the portion of said rearward wall beneath said cutting tooth and the forward wall conjointly defining the body of said cutting link;

at least a portion of said driving links each being defined by a plate-like body having a forward opening for accommodating said one rivet whereby said driving link is pivotally connected to one of said cutting links;

said driving link having a rearward opening for accommodating a further rivet for connecting said driving link to another one of the links;

said driving link further having a rearward trailing edge directly behind said last-mentioned rearward opening when viewed in the direction of movement of the saw chain along the cutter bar;

said body of the above-mentioned driving link having a safety projection extending upwardly and rearwardly out beyond said rearward trailing edge of the plate-like body of the driving link in a direction opposite to the direction of said movement, said projection having an outermost tip spaced rearwardly of said further rivet and defining a moment arm extending from said outermost tip to said further rivet, said moment arm having a center of rotation at said further rivet;

said cutting edge and the outermost tip of said projection tracing respective arcuate paths around the outer end of the cutter bar as the saw chain moves therearound; the arcuate path traced by said outermost tip having a larger radius of curvature than the arcuate path traced by said cutting edge thereby causing said outermost tip to strike the wood workpiece before said cutting edge and to apply a force against said outermost tip when the operator thrusts the cutter bar into the workpiece during the plunge-cutting mode of operation; said It has been found that in chains having a low overall height, the lifting action of the cutting link, according to the invention, occurs in an optimum manner if the difference between the diameter of the trajectory 13 described by the safety projection 6, and the diameter of the trajectory 14, described by the cutting link tips 16, is approximately 0.5 to 1.5 mm, preferably 1 mm.

FIG. 2 shows that when the chain rotates around the free end 12 of the guide rail 11, the end section of the safety projection 6 projects by the differential amount "s" beyond the trajectory 14 described by the cutting tip 16 of the cutting teeth 1, 2. In the position illustrated in FIG. 2, the cutting teeth are not yet in engagement, since in this position the feed pressure is not yet effective. As soon as the feed pressure is initiated, the chain begins to cut. FIG. 3 shows the position of the individual chain links with respect to the guide rail 11 and to the cutting radius $R_o$ and, in particular, at the instant of the beginning of the cutting operation.

Thus, at the point I, at the time of starting up, the force $F_1$ acts on the end section 15 of the safety projection 6. Due to this, the driving link 3 rotates about the pivot point $G_1$ of the connecting pin 5. The pivot point $G_1$ is supported by way of the lateral connecting links 4 at the point S on the guide rail 11. At the same time, the pivot point $G_2$, namely the center point of the front connecting pin 5 which connects the driving link 3 with the rear end of the cutting link 2, in the direction of rotation V, travels in a positive manner from $G_2$ to $G_2'$.

Consequently, the cutting tooth 2 is raised from the rail 11 at the rear end and is pressed, with the back of the tooth at the point II, towards the cutting radius $R_o$. At this instant, the force $F_2$ acts at the point II and presses at the point II on the back of the tooth, so that a moment $M_2=F_2\times a_2$ acts about the center point of the pivot pin, i.e. about the point $G_2$. This moment $M_2$ now rotates the cutting tooth 2 about the point $G_2$ towards the left, in the opposite direction to the direction of travel V, until the cutting edge 7 of the cutting tooth 2 comes into engagement in the wood to be cut.

Thus, the pivot point $G_3$, i.e. the center point of the leading connecting pin of the cutting tooth 2, is raised slightly with the leading driving link and moves from the position $G_3$ into the position $G_3'$. In this case, the cutting tooth 2 is raised, as a whole, slightly away from the track 11' of the rail 11. Furthermore, the cutting force $F_3$ is produced, which with the lever arm $a_3$ causes the moment $M_3=F_3\times a_3$ about the point $G_2'$. This causes a further rotation of the cutting tooth 3 about the point $G_2'$ which continues until the cutting edge 7 of the cutting tooth 2 is fully in engagement and the parameter $t=0$.

As a whole, the construction, according to the invention, provides a positively controlled lever action. This lever action is initiated by the rearmost section 15 of the outer edge 9 of the safety projection 6, which projects beyond the trajectory 14 of the cutting links 1, 2, upon the rotation about the free end of the chain. It leads to a continuous, smooth, and gentle abutment firstly of the end point of the back of the tooth and secondly of the cutting edge 7 of the cutting tooth. In this case the cutting tooth itself is firmly raised slightly from the track 11' of the rail 11. As a result, after the cutting force $F_3$ comes into being and after a furter rotation of the cutting tooth 2, the cutting edge 7 of the tooth finally comes into full engagement.

Because of the construction of an embodiment according to the invention, the cutting teeth are prevented from penetrating the wood in an uncontrolled manner and thus from causing kick-back effects. This construction facilitates a limited, accurately controlled penetration of the cutting teeeth 1, 2 with increasing feed. Consequently, it has become possible to virtually eliminate the kick-back effect.

In the advantageous embodiment illustrated, the amount s amounts to approximately 1 mm. The height $h_2$ (see FIGS. 2, 3) should be kept as small as possible, in order not to restrict the chip space undesirably. An inadequate chip space impairs the degree of efficiency of the chain, therefore restricting the chip removal.

For the construction of an advantageous embodiment of the chain according to the invention, the following geometric conditions have proven particularly advantageous: the height $h_2$, which is measured between the rearmost section 15 of the outer edge 9 of the safety projection 6 and the line 17 connecting the centers of the recesses 18, 19 in the driving link 3, should be at the most three-quarters of the distance $h_1$, which is measured between the diameter of the trajectory 14 of the tips of the cutting links 1, 2 and this line 17. Furthermore, the length $l_2$, between the free end of the outer edge 9 of the safety projection 6 and the line 24 which is perpendicular to the center of the driving link 3, should be at least equal to twice the distance $h_1$.

The following relationships thus exist:

$$h_2 \leqq \tfrac{3}{4} h_1$$

$$l_2 \geqq 2\, h_1$$

The length $l_2$ thus also follows the following geometric equation:

$$l_2 \geqq \sqrt{R_1^2 - (a + h_2)^2}\,,$$

in which case $$a = \sqrt{R_G^2 - \left(\frac{t}{2}\right)^2}$$

For this purpose, $R_1$ is the radius of the trajectory 13 described by the safety projection 6, a is the radial extend between the center Z of the track 11' of the rail 11 and the line 17 connecting the centers of the link pins of the driving link 3, $R_G$ is the radius from the center Z to the middle of the link pin 5, and t is the pitch of the chain (see FIG. 2).

Furthermore, the following geometric equations are thus provided:

$$R_1 \geqq \sqrt{R_G^2 - \left(\frac{t}{2}\right)^2} + h_1 + 1$$

$$R_o = \sqrt{R_G^2 - \left(\frac{t}{2}\right)^2} + h_1$$

In addition, the shape of the depth limiter is essential for the cutting behavior in the case of plunge cutting and longitudinal cutting operations. Accordingly, the depth limiter is constructed with a curved shape, in which case the outer edge 25 of the depth limiter 8 has at least approximately a curve length of $\alpha_T$, which is approximately 22 degrees, and a radius which is adapted, at least approximately, to the cutting radius $R_o$.

In FIG. 1, the geometric features for the construction of the depth limiter are illustrated diagrammatically. Accordingly, an appropriate embodiment exists if the distance b, which is measured between the center of the link pin 5 on the depth limiter 8 and the center Z' of the radius $R_T$, corresponds to approximately one-fifth of the pitch of the chain. Additionally, as a result of this position of the center Z' of the radius $R_T$ of the upper edge 25 of the depth limiter 8, the radius $R_T$ itself should be approximately equal to or greater than two-fifths of the cutting radius.

Therefore, expressed geometrically, the following conditions exist for the position and size of the radius $R_T$ for the upper edge 25 of the depth limiter 8:

$$b \approx \frac{1}{5} \times t$$

$$R_T \gtrsim \frac{2}{5} \times R_o$$

$$\alpha_T \approx 22°$$

This produces a depth limiter 8 having an upper edge 25 which is relatively long, as viewed in the direction of rotation, drops away slightly in the direction of rotation, and is slightly domed.

As a result of the combination of the safety projection 6 on the driving link 3, and the depth limiter 8, which is located relatively far from the upper end of each cutting tooth and comprises a relatively broad outer edge 25, optimum cutting results occur both in the case of cutting-off as well as in plunge cutting operations, while excluding the dangerous kick-back effects, especially at the time of plunge cutting operations. Due to the fact that only the end point of the safety projection 6 comes into abutment first of all and on its own, during the rotation about the free end of the guide rail, it is ensured that the effective lever length $L_2$ (see FIG. 2), which is necessary for the positive control of the cutting links, always remain constant and, therefore, the forces acting on the cutting teeth 1, 2 always keep the same value.

It is conceivable that the safety projection 6 also be located on a link other than the driving link 3 of the saw chain. Even in this case, the safety projection 6 would have a rear section 15 on its outer edge 9, which would correspond to the section 15 of the illustrated driving link 3. Also, this section 15, which could be located on any chain link, likewise has a trajectory which is greater by a predetermined amount s than the trajectory described by the tip of the cutting teeth 1, 2.

The section 15 of the outer edge of the safety projection, which forms the abutment in the bottom of the groove, can be constructed as a bearing face. The bearing face is located at right angles at the direction of travel, and seen in a vertical projection in the direction of the chain link, projects laterally beyond the chain link. The bearing face is accordingly larger than the material thickness of the chain link associated with the bearing face. This bearing face can be formed directly from the body of the chain link or a projection on the chain link, by bending-over, compression, or other methods of construction.

The chain, according to the invention, is particularly characterized by the fact that the parts of the chain links, which are located above the connecting pins 5, 5', 5'', etc., are, in an optimum manner, constructed to be low. Overall this produces a chain with an extremely low profile in comparison with known chain constructions.

The present invention is, of course, in no way restricted to the specific disclosure of the specification and drawings, but also encompasses any modifications within the scope of the appended claims.

What we claim is:

1. A saw chain for a power-driven chain saw useable in a plunge-cutting mode of operation and having a cutter bar defining a track for accommodating and guiding the saw chain as it moves along the cutter bar, the cutter bar having an outer end defining a predetermined curvature for the guide track, the saw chain comprising:

a plurality of cutting links, a plurality of connecting links, and a plurality of driving links, the links being pivotally interconnected by rivets or the like to define the saw chain, the cutting links including:

a plate-like body having a rearward wall defining a rearward opening for accommodating one of the rivets;

the rearward wall having an upwardly extending bent-over top portion defining the cutting tooth of the cutting link and a downwardly extending portion defining a rearward bottom edge of the cutting link, the cutting tooth being elongated and having a forward end defining the cutting edge thereof;

a forward wall having a downwardly extending portion defining a forward bottom edge of the cutting link;

the portion of said rearward wall beneath said cutting tooth and the forward wall conjointly defining the body of said cutting link;

at least a portion of said driving links each being defined by a plate-like body having a forward opening for accommodating said one rivet whereby said driving link is pivotally connected to one of said cutting links;

said driving link having a rearward opening for accommodating a further rivet for connecting said driving link to another one of the links;

said driving link further having a rearward trailing edge directly behind said last-mentioned rearward opening when viewed in the direction of movement of the saw chain along the cutter bar;

said body of the above-mentioned driving link having a safety projection extending upwardly and rearwardly out beyond said rearward trailing edge of the plate-like body of the driving link in a direction opposite to the direction of said movement, said projection having an outermost tip spaced rearwardly of said further rivet and defining a moment arm extending from said outermost tip to said further rivet, said moment arm having a center of rotation at said further rivet;

said cutting edge and the outermost tip of said projection tracing respective arcuate paths around the outer end of the cutter bar as the saw chain moves therearound; the arcuate path traced by said outermost tip having a larger radius of curvature than the arcuate path traced by said cutting edge thereby causing said outermost tip to strike the wood workpiece before said cutting edge and to apply a force against said outermost tip when the operator thrusts the cutter bar into the workpiece during the plunge-cutting mode of operation; said arcuate paths being radially spaced from each other a predetermined radial distance; the application of said force to said outermost tip and its movement through at least part of said radial distance about said moment arm causing a rotating moment to be applied to said drive link to rotate the same about said further rivet and act as a lever to lift said one rivet and said cutting link connected thereto in a direction away from the cutter bar thereby causing the rearward end of said top portion of said cutting link to move up against the base of the kerf in the workpiece to limit the extent to which said cutting edge can penetrate into the workpiece whereby unwanted kickback action is reduced.

2. A saw chain in combination according to claim 1, said openings of said driving link having centers therein, and said safety projection having an outer edge defining said outermost tip and extending approximately parallel to a line connecting said centers of said openings of said drive link.

3. A saw chain in combination according to claim 2, in which the distance between the rearmost edge of said safety projection, and said line connecting said centers of said openings, amounts to not more than approximately three-quarters of the distance between said line and said arcuate path traced by the cutting edges of said cutting links.

4. A saw chain in combination according to claim 3, in which the length between the rearmost edge of said safety projection, and a vertical line through the center of said driving link, is equal to at least twice the distance between said line and said arcuate path traced by the cutting edges of said cutting links.

5. A saw chain in combination according to claim 2, said outer edge of said safety projection extending straight-lined.

6. A saw chain in combination accordiing to claim 2, in which said outer edge of said safety projection passes into a curve extending in a concave manner towards the center of said driving link, and in which said curve is adjoined, in the region of the forward opening, by a portion of the convex curve in such a way that said forward opening is surrounded on more than one quarter of its forward part, approximately in the shape of a ring, by the body of said driving link.

7. A saw chain in combination according to claim 5, in which the rearmost edge of said safety projection being a straight edge for bearing in the bottom of the kerf during plunge-cutting operations, said rearmost edge being rounded off with a small radius to define said outermost tip.

8. A saw chain in combination to claim 7, in which said radius is less than 1 mm.

9. A saw chain in combination according to claim 7, in which said outer edge of said safety projection has an outwardly tapering cross section.

10. A saw chain in combination according to claim 1, said predetermined radial distance being approximately 0.5 to 1.5 mm.

11. A saw chain in combination according to claim 10, in which said radial distance is 1 mm.

12. A saw chain in combination according to claim 1, said forward wall of the cutting link defining a depth limiter having an outer edge which is adapted approximately to the cutting radius of said saw chain.

13. A saw chain in combination according to claim 12, in which the position and size of the radius of said outer edge of said depth limiter is determined by the following conditions:

$$b = 1/5 \times t$$

$$R_T \approx > 2/5 \times R_o$$

where b is the clearance of the center of a circle of the radius of a curve defined by said outer edge of said depth limiter, t is the pitch of said chain, and $R_o$ is said cutting radius.

14. A saw chain in combination according to claim 12, in which said outer edge of said depth limiter has a radius, the longitudinal range of which is approximately 22 degrees.

* * * * *

UNITED STATES PATENT AND TRADEMARK OFFICE

CERTIFICATE OF CORRECTION

PATENT NO. : 4,459,890

DATED : July 17, 1984

INVENTOR(S) : H. Dolata et al

It is certified that error appears in the above-identified patent and that said Letters Patent is hereby corrected as shown below:

In column 4, line 55: delete [9"] second occurrence and isert -- 9' --.

In column 5, line 62: delete [firmly] and substitute -- finally -- therefor.

In column 5, line 64: delete [furter] and substitute -- further -- therefor.

In column 6, line 23: delete [$l_2$] and substitute -- $l_2$ -- therefor.

In column 6, line 33: delete [$l_2$] and substitute -- $l_2$ -- therefor.

In column 7, line 43: delete [remain] and substitute -- remains -- therefor.

In column 7, line 57: delete [at] second occurrence and substitute -- to --.

In column 9, line 38: delete [accordiing] and substitute -- according -- therefor.

Signed and Sealed this

*Sixteenth* Day of *September 1986*

[SEAL]

*Attest:*

DONALD J. QUIGG

*Attesting Officer*

*Commissioner of Patents and Trademarks*